United States Patent [19]

Osawa et al.

[11] Patent Number: 4,683,185

[45] Date of Patent: Jul. 28, 1987

[54] ELECTROPHOTOSENSITIVE MEMBER HAVING A DEPLETION LAYER

[75] Inventors: Izumi Osawa, Ikeda; Isao Doi, Toyonaka; Toshiya Natsuhara, Amagasaki, all of Japan

[73] Assignee: Minolta Camera Kabushiki Kaisha, Osaka, Japan

[21] Appl. No.: 753,450

[22] Filed: Jul. 10, 1985

[30] Foreign Application Priority Data

Jul. 16, 1984 [JP] Japan ..... 59-147919

[51] Int. Cl.[4] ..... G03G 5/082

[52] U.S. Cl. ..... 430/57; 430/84; 430/95

[58] Field of Search ..... 430/57, 58, 69, 60, 430/84, 95

[56] References Cited

U.S. PATENT DOCUMENTS 4,365,013 12/1982 Ishioka et al. ..... 427/74
4,490,450 12/1984 Shimizu et al. .
4,491,626 1/1985 Kawamura et al. ..... 430/60
4,495,262 1/1985 Matsuzaki et al. ..... 430/58

FOREIGN PATENT DOCUMENTS 56-150753 11/1981 Japan .
57-115552 7/1982 Japan .
58-154850 9/1983 Japan .
58-171038 10/1983 Japan .

*Primary Examiner*—John L. Goodrow
*Attorney, Agent, or Firm*—Burns, Doane, Swecker & Mathis

[57] ABSTRACT

Though a-Si:Ge has a high absorption of long wave light, so that it can be used to improve the electrophotosensitive members in the sensitivity, and it is expected as photosensitive members for printers using semiconductor laser. However, a-Si:Ge has a tendency to prevent the movement of a carrier generated to lower a sensitivity and increase a residual potential.

In the present invention, the above problems are improved by forming a depletion layer in a-Si:Ge layer to improve the mobility in forward direction of the carrier.

11 Claims, 4 Drawing Figures

Fig. 1
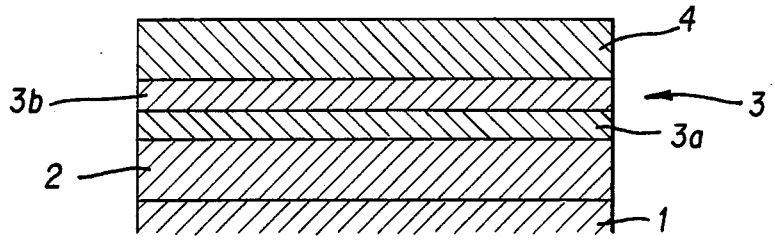
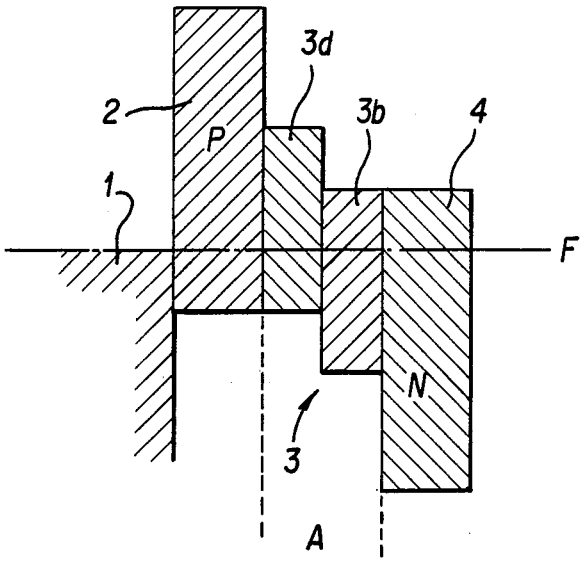
Fig. 2

ELECTROPHOTOSENSITIVE MEMBER HAVING A DEPLETION LAYER

BACKGROUND OF THE INVENTION

The present invention relates to an electrophotosensitive member, and more particularly to a photosensitive member having an amorphous silicon:germanium photoconductive layer.

Amorphous silicon:germanium (hereinafter referred to as a-Si:Ge), because of its small band gap as compared with amorphous silicon (hereinafter referred to as a-Si), shows a high absorption toward long wavelength light. Since, therefore, it contributes to the generation of many carriers and improvement in the sensitivity toward long wavelength light, it is expected to be used in the future as a photosensitive member for printers using a semiconductor laser. Also, since its sensitivity toward short-wave light is not damaged, it can be applied to plain paper copiers (hereinafter referred to as PPC) by regulating the emission spectrum of exposure lamps. Also, a-Si:Ge has an excellent feature that, because of its layer well absorbing long wavelength light, there is little disturbance of images by interference of light frequently encountered in the conventional amorphous silicon (a-Si) photosensitive members.

Because of these features, many studies for applying a-Si:Ge to photosensitive members are being made.

For example, there is disclosed a technique to use a-Si:Ge over the whole region of a photosensitive layer [Japanese Patent Application Kokai (Laid-open) No. 171038/1983]; a technique directly on a conductive base of a photosensitive member (U.S. Pat. No. 4,490,450); and a technique to apply a-Si:Ge to a layer in direct contact with the surface layer and/or substrate of a photosensitive member (ibid., No. 150753/1981). But, none of these techniques makes no proposal to make a depletion layer in the a-Si:Ge layer.

For example, said patent application No. 171038/1983 includes the formation of a-Si:Ge layer over the whole region of the photosensitive layer, but a-Si:Ge has its own defect that it is small in $\mu\tau$ (carrier range) and low in carrier-carrying efficiency. When a-Si:Ge is therefore applied over the whole region of the photosensitive layer, generated carriers are trapped by the a-Si:Ge layer to cause not only reduction of sensitivity, but also generation of light fatigue and residual potential.

Also, as described in said U.S. Pat. No. 4,490,450 and in said Japanese Patent Application Kokai (Laid-open) No. 150753/1981, when the a-Si:Ge layer has been applied as the base of the photosensitive layer, because of a-Si:Ge being easy to generate thermally excited carriers, injection of carriers at the base becomes easy to cause reduction of charging capability. Besides, when the thickness of the a-Si:Ge layer is made large in order to eliminate interference patterns generated in printers using semiconductor laser ray or long-wave coherent light as a light source, carriers present in the vicinity of the base are trapped by the a-Si:Ge layer to cause reduction in sensitivity and generation of light fatigue and residual potential.

Further, as disclosed in Japanese Patent Application Kokai (Laid-open) No. 150753/1981, when the a-Si:Ge layer has been applied to the outermost surface of photosensitive members, carriers excited by short-wave light cannot migrate to move out of the layer to fail to contribute to sensitivity. While, when the thickness of the a-Si:Ge layer is made large in order to inhibit interference of light, carriers are trapped in the layer. Also, a-Si:Ge generates a large number of thermally excited carriers to cause injection of charges from the surface and this obviously lowers the charging capability.

For this reason, the foregoing conventional techniques do not make the best use of the excellent characteristics of a-Si:Ge.

On the other hand, Japanese Patent Application Kokai (Laid-open) No. 154850/1983 discloses an example of providing triple layers of a-Si:Ge to form the photosensitive member which has a photosensitivity extending to the long wavelength region. But the object of this photosensitive member is to control specific resistance and conductivity. This patent application does not refer at all to formation of a depletion layer in the a-Si:Ge layer for solving the problems encountered in using a-Si:Ge, i.e. a reduction in carrier-carrying efficiency accompanied by reduction of sensitivity and generation of light fatigue and residual potential.

As described above, a-Si:Ge, because of its small band gap as compared with a-Si, shows a high absorption toward long wavelength light, and therefore, it contributes to the generation of many carriers and improvement in the sensitivity toward long wavelength light.

But, the function of electrophotosensitive members does not work at all by mere doping of Ge. For example, high degrees of doping of Ge, when carried out randomly, increase the impurity level in the band gap to cause a reduction in the charge accepting capability, this change accepting capability being essential to electrophotosensitive members. As a result, excellent electrostatic latent images are no longer obtained.

Also, since a-Si:Ge will increase the number of carriers generated but disturbs the movement of them, careless increasing of the amount of Ge added as well as the thickness of the a-Si:Ge layer makes the movement of carriers impossible, thereby causing the reduction of sensitivity, generation of residual potential, etc. In addition, because erasing is not also sufficiently attained, there occur very unfavorable results for electrophotography such as generation of memory, etc.

On the other hand, in electrophotography with coherent light as a light source such as laser beam printers, etc., sufficient absorption of long wavelength light should be carried out in order to inhibit the generation of interference phenomenon.

SUMMARY OF THE INVENTION

It is accordingly a primary object of the present invention to provide a novel electrophotosensitive member free of the aforedescribed disadvantages and having an excellent property for obtaining images of good qualities.

Another object of the present invention is to provide an electrophotosensitive member which includes an amorphous silicon:germanium photoconductive layer having a depletion layer and which is low in residual potential and high in charge retaining capability as well as in sensitivity.

These and other objects of the present invention are achieved by providing an electrophotosensitive member which includes a conductive substrate, a first layer composed substantially of amorphous silicon and formed on said conductive substrate, a second layer formed on said first layer and composed substantially of amorphous silicon:germanium and including a depletion layer, and a third layer on said second layer and composed substantially of amorphous silicon.

By the foregoing construction of the photosensitive member according to the present invention, the mobility of charge carriers generated in the second layer has been remarkably improved so that the charge carriers are moved out of the layer without being trapped and as this second layer is sandwiched by the first and third layers composed substantially of amorphous silicon which have excellent charge carrier transporting properties, charge carriers move through both layers to improve the sensitivity without causing the rise in the residual potential.

BRIEF DESCRIPTION OF THE DRAWINGS

FIG. 1 shows a typical sectional view of the photosensitive member of the present invention;

FIG. 2 shows a typical view illustrating the present photosensitive member used in a positively charged state by means of a band gap;

DETAILED DESCRIPTION OF THE INVENTION

Figure 3:
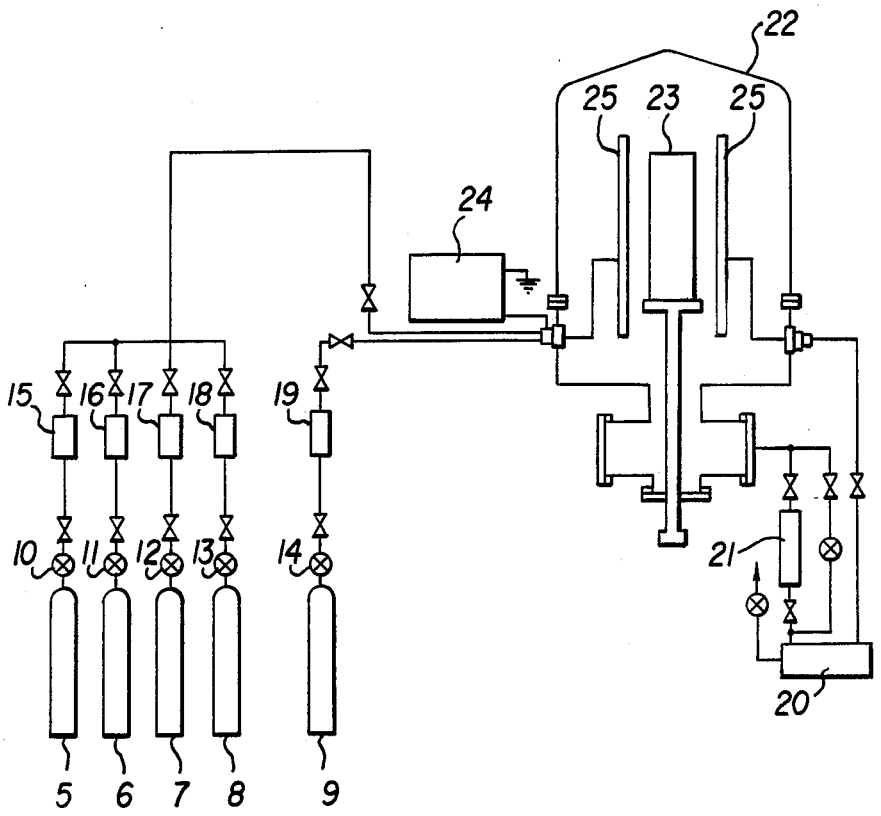
FIG. 3 shows a glow discharge decomposition apparatus for manufacturing the photosensitive member of the present invention.

A typical sectional view of one embodiment of the electrophotosensitive member of the present invention is shown in FIG. 1. FIG. 2 is a typical view illustrating the electrophotosensitive member of the present invention used in a positively charged state by means of an energy level.

Referring to FIG. 1, a first layer (2) composed substantially of a-Si is formed on a conductive substrate (1) and to this first layer (2), a second layer (3) composed substantially of amorphous silicon:germanium is formed and further a third layer (4) composed substantially of amorphous silicon on said second layer (3). It should be noted that each of these layers may contain proper hetero atoms such as O, N, C, B, P, etc.

The second layer (3) includes a lower layer (3*a*) and an upper layer (3*b*) to form a depletion layer therebetween. To form the depletion layer in said second layer (3), the polarities of the upper and lower layers (3*b*) and (3*a*) should be controlled such that when either of the layer is P-type, the other is N-type or intrinsic and when one of the layer is strongly P-type, the other may be a weak P-type and when strongly N-type, the other may be a weak N-type. These P, N and intrinsic types may be controlled primarily by controlling the amounts of inclusion of the Group III A or VA atom (preferably B or P) of the Periodic Table.

FIG. 2 illustrates the construction of the photosensitive member used in a positively charged state by means of band gap. The first layer (2) of a-Si of P-type is formed in contact with the substrate (1), and the second lower layer (3*a*) of a-Si:Ge of P-type, the upper layer (3*b*) of a-Si:Ge of N-type and the third layer (4) of a-Si of N-type are successively formed in this order. As seen in FIG. 2, the first layer (2) and the second lower layer (3*a*) are P-types whereas the second upper layer (3*b*) and the third layer (4) are N-types and the depletion layer (A) is formed in the second layer (3).

The first characteristic of the present invention is to provide the second layer (3) of a-Si:Ge between the first and third layers (2) and (4) of a-Si as shown in FIG. 1, and the second one is to make a depletion layer (A) in the second layer as shown in FIG. 2.

In the present invention, a reason why the second layer (3) of a-Si:Ge is sandwiched between the first and third layers (2) and (4) of a-Si is to make it easy for carriers generated in the second layer to move into both the first and third layers, thereby making it difficult for the carriers to be trapped within the second layer.

Specifically, carriers generated in the second layer can move into the both first and third layers (2) and (4), so that the number of trapped carriers becomes small. Consequently, the thickness of the second layer can be made large, and also injection of charges from the surface of the third layer (4) and the substrate (1) is inhibited so that reduction in charging capacity can be prevented.

In the present invention, the second layer (3) of a-Si:Ge is situated in a position within a range of 20 to 80% from the surface of the substrate (1) based on the total thickness of the first, second and third layers (2), (3) and (4). When the layer is placed within 20% of the total thickness from the substrate, injection of charges becomes easy, the charging capability lowers and besides the contribution of generated carriers to sensitivity becomes poor. Similarly, when the layer is placed beyond 80% of the total thickness from the substrate, i.e. within 20% of the total thickness from the surface of the third layer (4), problems of charging capability and sensitivity occur.

The thickness of the second layer (3) of a-Si:Ge is preferably make 100 Å to 20 μm. When the thickness is less than 100 Å, the sensitivity toward long wavelength light based on a-Si:Ge lowers so that application to laser beam printer (hereinafter referred to as LBP) becomes impossible. While, when it is more than 20 μm, generation of light fatigue becomes easy and residual potential tends to rise.

The Ge atom concentration in the second layer (3) is preferably within a range of 2 to 70 atomic % (hereinafter referred to as at %), more preferably 8 to 50 at % based on the total number of Si atoms and Ge atoms. When the Ge atom concentration is small, the thickness of the layer may be made large.

A relationship between the thickness d (in micrometers) of the second layer (3) which is represented by a-$Si_{(1-x)}$:$Ge_xH$ (x: number of Ge atoms expressed by a ratio of Ge/(Si+Ge)) and the Ge concentration x satisfies the following equation:

$$0.07 \leqq dx^2 \leqq 0.90$$

When $dx^2$ is smaller than 0.07, problems due to interference of light occur, and when it is larger than 0.90, the charge acceptance capability lowers.

As apparent from the above equation satisfied by the second layer (3) of the present invention, the thickness d is generally large when x is small or vice versa. The inclusion of a large amount of Ge will require less thickness of the layer (3) whereas a small amount of Ge will require more thickness.

The light characteristics of the second layer (3) may be improved by incorporating other elements such as carbon, oxygen, nitrogen, etc. in the layer. Incorporation of oxygen is effective in terms of improvement in charge acceptance capability and reduction in light fatigue. The amount of oxygen is preferably made 0.01 to 5 at % based on Si atoms.

In the photosensitive member of the present invention, a depletion layer is made by regulating the polarity of the second layer (3) as shown in FIG. 2.

In photosensitive members of such embodiment as shown in FIG. 2, a depletion layer is formed in the junction region of the lower P-type layer (3*a*) and the upper N-type layer (3*b*). Thus, when positively charged and exposed to a light of long wavelength, the second layer (3) is light excited to generate a large amount of charge carriers. In the upper layer (3*b*) which is N-type, electrons are generated and easily extracted out to the third layer (4). In the lower layer (3*a*) which is P-type, holes are generated to move out to the first layer (2). As the third layer (4) is also N-type, electrons move through this layer to neutralize positive charges whereas holes easily move out to the substrate (1) as the first layer (2) is P-type.

When the photosensitive member is to be negatively charged, it suffices to reverse the regulation of polarity shown in FIG. 2. This is to say that the first layer (2) and the second lower layer (3*a*) be made N-type and the second upper layer (3*b*) and the third layer (4) be made P-type. As noted above, the lower and upper layers (3*a*), (3*b*) may not necessary be P and N type respectively but the one layer may be P-type (or N-type) and the other be intrinsic or strongly P-type (or N-type) for the one layer and a weak P-type (or N-type) for the other. The polarity of the first layer (2) should be some as the lower layer (3*a*) although its conductivity may be stronger and for the third layer (4), the polarity is the same as the upper layer (3*b*) although its conductivity can be made stronger.

For the regulation of polarity, it suffices to incorporate an atom belonging to Group III or V of the periodic table in the second layer (3).

As the atom of Group III, the atom of Group III A, particularly boron is preferred. As the atom of Group V, the atom of Group VA, particularly phosphorous is preferred. The amount of the atom of Group III incorporated be not more than 200 ppm, more preferably 3 to 100 ppm based on the Si atom. The amount of the atom of Group V incorporated is not more than 50 ppm, preferably 1 to 20 ppm.

When the photosensitive member is used in a positively charged state, it is preferred that the amount of the atom of Group III is made rich in the first layer (2) and the lower layer (3*a*) and poor in the upper layer (3*b*) and in the third layer (4). In another form, the upper layer (3*b*) as well as the third layer (4) may be made of N-type by incorporating less than 50 ppm of the atom of Group V and that the first layer (2) and the lower layer (3*a*) may be made of P-type using the atom of Group III.

When the photosensitive member is used in a negatively charged state, it is preferred that the amount of the atom of Group III is made poor in the first layer (2) and the lower layer (3*a*) and rich in the upper layer (3*b*) and in the third layer (4). Instead the first and lower layers may be incorporated with the atom of Group V. Although dependent on various conditions, a-Si or a-Si:Ge without B or P is generally N-type and becomes P-type with more than 10 ppm of B. On the other hand, the inclusion of P or less than about 5 ppm of B makes a-Si and a-Si:Ge N-type. And 5 to 10 ppm of B will make a-Si and a-Si:Ge intrinsic.

The thickness of each of the first and third layers (1), (3) is 1 to 50 μm, more preferably 5 to 30 μm. When it is less than 1 μm, the charge injection-inhibiting effect at the time of charging becomes poor to cause reduction in charging capability. When it is more than 50 μm, there appear adverse effects that the movement distance of carriers becomes so long that opportunity for the carrier to be trapped increases, and therefore that a rise in residual potential is caused.

In the present invention, PN, PI or NI junction is carried out so as to give backward bias by regulating the polarity also of the first and third layers. When the photosensitive member is used in a positively charged state, the first layer (2) at the substrate side is made of P-type and the third layer (4) is made of N-type as shown in FIG. 2. It is extremely easy for carriers generated by exposure to move toward the substrate or surface, because the above structure eliminates barriers to the movement of carriers.

When the photosensitive member is in a positively charged state, it takes such band-gap construction that the first layer (2) at the substrate side takes the highest level relative to the Fermi level (F), and that the third layer (4) takes the lowest level relative thereto, as shown in FIG. 2. In the case of a negatively charged state, the above construction is reversed.

Further, carbon, oxygen, nitrogen, etc. may be incorporated in the first and third layers (2) and (4). Incorporating carbon in the third layer (4) results in improvement in the moisture resistance of the surface as well as improvement in charge retention and light permeability. The carbon content is not less than 35 at %, particularly preferably not less than 50 at % based on the total amount of the Si and C atoms.

Oxygen and nitrogen are particularly useful to improve dark resistance and reduce light fatigue. Particularly, incorporating much oxygen in the first layer in contact with the substrate can improve the charging capability of the photosensitive member. The oxygen content is 0.05 to 5 at %, more preferably 0.1 to 2 at % based on the Si atom.

The photosensitive member of the present invention can be produced by the usual methods for example as follows: The first layer is deposited on a substrate (e.g. aluminum) by applying glow discharge to a mixed gas comprising $SiH_4$, $Si_2H_6$, suitable carrier gasses (e.g. $H_2$, Ar) and required herero atoms; the second layer is then deposited on the first layer by applying glow discharge to a mixed gas comprising $SiH_4$, $GeH_4$ and hereto atoms; and similarly, the third layer is deposited on the second layer.

In the photosensitive member of the present invention, the second layer is sandwiched between layers composed substantially of a-Si, and besides a complete depletion layer is made in the second layer. As a result, since carriers generated in the second layer can easily move into either of the first or third layer, the movement distance becomes short to decrease opportunity for the carrier to be trapped in the second layer. As a result, reduction in residual potential can be attained.

In addition, making the depletion layer increases the carrier-generating efficiency, lowers the dark decay, and decreases the residual potential, so that the sensitivity improves and light fatigue reduces.

The present invention will be illustrated hereinafter with reference to the following examples.

EXAMPLE 1

Production of the photosensitive member A:

Step (1):

In a decomposition apparatus with glow discharge shown in FIG. 3, the inner part of the reactor (22) was exhausted to a high vacuum of about $10^{-6}$ Torr by operating first a rotary pump (20) and then a diffusion pump (21). After opening the 1st to 3rd and 5th controlling valves (10), (11), (12) and (14), $H_2$ gas in the 1st tank (5), 100% $SiH_4$ gas in the 2nd tank (6), $B_2H_6$ gas, diluted to 200 ppm with $H_2$, in the 3rd tank (7) and $O_2$ gas in the 5th tank (9) were sent to mass flow controllers (15), (16), (17) and (19), respectively, under an output guage of 1 kg/cm$^2$. Thereafter, the flow amounts of $H_2$, $SiH_4$, $B_2H_6/H_2$ and $O_2$ gases were set on 494 sccm (standard cubic cm/min), 100 sccm, 5.0 sccm and 1.0 sccm, respectively, by adjusting the scales of the respective mass flow controllers, and every gas was sent to the reactor (22). After the flow rate of every gas was stabilized, the inner pressure of the reactor (22) was adjusted to 1.0 Torr. Separately, an aluminum drum of 80 mm in diameter, an electroconductive substrate (23), in the reactor (22) was heated to 250° C. in advance. At the point when both the flow rate of every gas and the inner pressure were stabilized, a high-frequency power source (24) was turned on and a power of 250 watts (frequency, 13.56 MHz) was applied to electrodes (25) to generate glow discharge. This glow discharge was continued for about 4.8 hours to deposit the first layer (2) of an a-Si photoconductive layer of about 12 μm in thickness containing hydrogen, boron and a trace amount of oxygen on the electroconductive substrate (23) [(1) in FIG. 1].

Step (2):

At the point when the first layer (2) was formed, application of power from the high-frequency power source (24) was stopped and at the same time, the flow amount of every mass flow controller,was set on zero, and the reactor (22) was thoroughly degassed. Thereafter, 478 sccm of $H_2$ gas, 100 sccm of 100% $SiH_4$ gas, 4 sccm of $B_2H_6$ gas diluted to 200 ppm with $H_2$, 17 sccm of $GeH_4$ gas and 1 sccm of $O_2$ gas were sent to the reactor from the 1st, 2nd, 3rd, 4th and 5th tanks [(5), (6), (7), (8) and (9)] respectively. After adjusting the inner pressure to 1.0 Torr, the high-frequency power source was turned on to apply a power of 250 watts. Glow discharge was continued for 60 minutes to deposit the second lower layer (3*a*) of a-Si:Ge of about 2.5 μm in thickness. The germanium content at that time was about 25 at %.

Step (3):

At the point when the second lower layer was formed, application of power from the high-frequency power source (24) was stopped and at the same time, the flow amount of every mass flow controller was set on zero, and the reactor (22) was thoroughly degassed. Thereafter, 480.5 sccm of $H_2$ gas, 100 sccm of 100% $SiH_4$ gas, 1.5 sccm of $B_2H_6$ gas diluted to 200 ppm with $H_2$, 17 sccm of $GeH_4$ gas and 1 sccm of $O_2$ gas were sent to the reactor from the 1st, 2nd, 3rd, 4th and 5th tanks [(5), (6), (7), (8) and (9)] respectively. After adjusting the inner pressure to 1.0 Torr, the high-frequency power source was turned on to apply a power of 250 watts. Glow discharge was continued for 60 minutes to deposit the second upper layer (3*b*) of a-Si:Ge of about 2.5 μm in thickness. The germanium content at that time was about 25 at %.

Step (4):

Procedure was carried out in the same manner as in Step (1) except that the flow amounts of $H_2$ gas and $B_2H_6$ gas diluted to 200 ppm with $H_2$ were 498.5 sccm and 0.5 sccm, respectively, to deposit the third layer (4) of a-Si layer. The thickness of the third layer was determined to be 12 μm.

The photosensitive member thus obtained was placed in a xerographic copying machine (EP 650Z; produced by Minolta Camera Co., Ltd.), and used for copying in a positively charged state. As a result, clear and high-density images superior in resolving power and good in gradation reproducibility were obtained. Continuous copying was carried out 50000 times, but reduction in image characteristics was not observed, and good copies were obtained to the last. Further, copying was carried out under a high-temperature and high-humidity condition such as 30° C.×85%, but the electrophotographic characteristics and image characteristics did not differ at all from those under room temperature conditions. The photosensitive member thus obtained was designated as photosensitive member A hereinafter.

COMPARATIVE EXAMPLE 1

Production of the photosensitive member S

In the same manner as in Example 1, a photosensitive member comprising the first layer (2) of 13 μm thick, second lower layer (3*a*) of 5 μm thick and third layer (4) of 12 μm thick was produced [second upper layer (3*b*) was not made]. The photosensitive member obtained was designated as photosensitive member S hereinafter.

COMPARATIVE EXAMPLE 2

Production of the photosensitive member T

In the same manner as in Steps (1), (2) and then repeating the step (1) of Example 1, the first layer (2) of 13 μm thick, second lawer layer of 5 μm thick and a-Si layer of 12 μm thick were made, respectively, in this order on an Al drum to produce a photosensitive member. The photosensitive member obtained was designated as photosensitive member T hereinafter.

COMPARATIVE EXAMPLE 3

Production of the photosensitive member U

A photosensitive member was produced in the same manner as in Example 1 except that Steps (2), (3) and (4) were omitted, and that the thickness of the first layer (2) is made 30 μm by Step (1) only. The photosensitive member obtained was designated as photosensitive member U hereinafter.

Evaluation test 1

Figure 4:
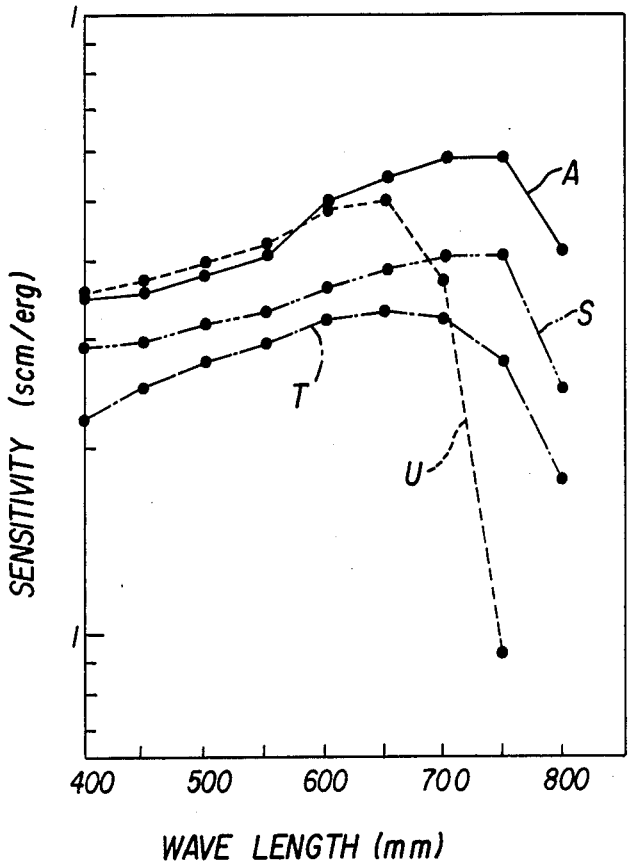
FIG. 4 shows relationships between wavelength and sensitivity obtained with the present photosensitive member and the depletion layer-free a-Si and a-Si:Ge photosensitive members.

To the photosensitive members A, S, T and U obtained in Example 1 and Comparative examples 1 to 3 was applied corona discharge at 600 V, and then spectral sensitivity was measured to obtain the result shown in FIG. 4. In the figure, (A), (S), (T) and (U) show the results obtained with the corresponding photosensitive members A, S, T and U, respectively. The abscissa shows wave-length (nm) and the ordinate shows sensitivity (scm/erg). As is apparent from FIG. 4, it can be seen that the photosensitive member of the present invention has high sensitivity toward long wavelength light, and besides that its sensitivity toward short-wave light is not damaged. Consequently, it can be used for both LBP and PPC.

Evaluation test 2

Using the photosensitive members A, S, T and U, practical copying was tried at a rate of 13 cm/sec on a laser beam printer with semiconductor laser as a light source. As a result, it was found that the photosensitive members A, S and T gave a good image, but that the photosensitive member U gave fog.

The photosensitive member A can give clear images with no generation of memory even by a highest-speed laser beam printer (32 cm/sec).

Evaluation test 3

A current density ($\mu A/cm^2$) of corona discharge required for the photosensitive members A, S, T and U to be charged to 600 V was obtained by measuring current flowing into the photosensitive members and charged area. The result is shown in Table 1.

TABLE 1

| Photosensitive member | A | S | T | U |
|---|---|---|---|---|
| Current density ($\mu A/cm^2$) | 0.27 | 0.30 | 0.41 | 0.35 |

The result above shows that the photosensitive member of the present invention is excellent in the charging characteristics.

What is claimed is:

1. An electrophotosensitive member which comprises:

a substrate;

a first layer of amorphous silicon having a thickness of about 5 $\mu$m to 30 $\mu$m;

a second photoconductive layer of amorphous silicon: germanium formed on said first layer and having a thickness of about 100 angstroms to 20 $\mu$m and including a depletion layer of amorphous silicon:germanium; and a third layer of amorphous silicon formed on said second layer and having a thickness of about 5 $\mu$m to 30 $\mu$m, said second layer being located at a distance from the surface of the substrate within a range of 20 to 80% of the total thickness of said first, second and third layers.

2. An electrophotosensitive member as claimed in claim 1 wherein the concentration of atoms in the second layer of amorphous silicon:germanium is represented as a $Si_{(1-x)}:Ge_xH$ (x: numer of Ge atoms expressed by a ratio of Ge/(Si+Ge)) and its thickness d satisfies the relationship $0.07 \leqq dx^2 \leqq 0.90$.

3. An electrophotosensitive member as claimed in claim 2 wherein the second layer of amorphous silicon:germanium comprises a lower layer and an upper layer to form the depletion layer.

4. An electrophotosensitive member as claimed in claim 3 wherein the first layer of amorphous silicon and the lower layer of the second layer of amorphous silicon:germanium are P-type whereas the third layer of amorphous silicon and the upper layer of the second layer of amorphous silicon:germanium are N-type.

5. An electrophotosensitive member as claimed in claim 4 wherein said P-type layers include less than about 200 ppm of an impurity element in Group IIIA of the Periodic Table.

6. An electrophotosensitive member as claimed in claim 4 wherein said N-type layers include less than about 50 ppm of an impurity element in Group VA of the Periodic Table.

7. An electrophotosensitive member as claimed in claim 3 wherein the first layer of amorphous silicon and the lower layer of the second layer of amorphous silicon:germanium are N-type, whereas the third layer of amorphous silicon and the upper layer of amorphous silicon:germanium are P-type.

8. An electrophotosensitive member as claimed in claim 7 wherein said P-type layers include less than about 200 ppm of an impurity element in Group IIIA of the Periodic Table.

9. An electrophotosensitive member as claimed in claim 1 wherein the first layer further includes about 0.05 to 5 atomic % of oxygen.

10. An electrophotosensitive member as claimed in claim 1 wherein the third layer further includes less than about 35 atomic % of carbon.

11. An electrophotosensitive member which comprises a substrate having, in order, a first layer of amorphous silicon having a thickness of about 5 to 30 $\mu$m, a second photoconductive layer of amorphous silicon:germanium having a thickness of about 100 Å to 20 $\mu$m and including a depletion layer of amorphous silicon:germanium and a third layer of amorphous silicon having a thickness of about 5 to 30 $\mu$m and including carbon, said second layer of amorphous silicon:germanium being located at a distance from the substrate within 20 to 80% of the total thickness of the first, second and third layers, and having a thickness d which satisfies the relationship $0.07 \leqq dx^2 \leqq 0.90$ where x is the number of Ge atoms in the layer expressed by a ratio of Ge/(Si+Ge).

* * * * *